US005575146A

United States Patent [19]

Borkowicz et al.

[11] Patent Number: 5,575,146

[45] Date of Patent: Nov. 19, 1996

[54] TERTIARY FUEL, INJECTION SYSTEM FOR USE IN A DRY LOW NOX COMBUSTION SYSTEM

[75] Inventors: Richard J. Borkowicz, Westminster, Md.; L. Berkley Davis, Jr., Schenectady; Masayoshi Kuwata, Ballston Lake, both of N.Y.

[73] Assignee: General Electric Company, Schenectady, N.Y.

[21] Appl. No.: 435,293

[22] Filed: May 5, 1995

Related U.S. Application Data

[62] Division of Ser. No. 987,957, Dec. 11, 1992, Pat. No. 5,487,275.

[51] Int. Cl.[6] ..... F02C 7/228

[52] U.S. Cl. ..... 60/39.06

[58] Field of Search ..... 60/39.02, 39.06, 60/732, 733, 737, 746, 747, 748

[56] References Cited

U.S. PATENT DOCUMENTS

| | | | |
|---|---|---|---|
| 2,999,359 | 9/1961 | Murray | 60/733 |
| 3,811,277 | 5/1974 | Markowski | 60/746 |
| 4,045,956 | 9/1977 | Markowski et al. . | |
| 4,292,801 | 10/1981 | Wilkes et al. | 60/747 |
| 4,603,548 | 8/1986 | Ishibashi et al. . | |
| 4,944,149 | 7/1990 | Kuwata . | |
| 4,949,538 | 8/1990 | Iasillo et al. | 60/39.465 |
| 4,982,570 | 1/1991 | Waslo et al. | 60/737 |
| 4,984,429 | 1/1991 | Waslo et al. | 60/752 |
| 5,069,029 | 12/1991 | Kuroda et al. | 60/733 |
| 5,081,843 | 1/1992 | Ishibashi et al. . | |
| 5,121,597 | 6/1992 | Urushidani et al. . | |
| 5,127,221 | 7/1992 | Beebe | 60/733 |
| 5,193,346 | 3/1993 | Kuwata et al. . | |
| 5,199,265 | 4/1993 | Borkowicz | 60/746 |
| 5,211,004 | 5/1993 | Black . | |
| 5,253,478 | 10/1993 | Thibault, Jr. et al. . | |
| 5,259,184 | 11/1993 | Borkowicz et al. . | |
| 5,274,991 | 1/1994 | Fitts . | |
| 5,295,352 | 3/1994 | Beebe et al. . | |
| 5,319,931 | 6/1994 | Beebe et al. | 60/39.821 |
| 5,323,614 | 6/1994 | Tsukahara et al. | 60/737 |
| 5,345,768 | 9/1994 | Washam et al. . | |

*Primary Examiner*—Timothy S. Thorpe
*Attorney, Agent, or Firm*—Nixon & Vanderhye

[57] ABSTRACT

An improved gas turbine combustor of the type including primary and secondary combustion chambers with a venturi including a throat portion located therebetween; a plurality of primary fuel injection nozzles secured to a combustor cap in an annular array upstream of the primary combustion chamber; and a centerbody including a secondary fuel nozzle, said centerbody extending from said combustor cap to said secondary combustion chamber; the improvement comprising a plurality of tertiary fuel injection nozzles arranged in a circular array about a longitudinal axis of the combustor, at a downstream of said venturi throat portion, for injecting fuel into the secondary combustion chamber.

9 Claims, 3 Drawing Sheets

TERTIARY FUEL, INJECTION SYSTEM FOR USE IN A DRY LOW NOX COMBUSTION SYSTEM

This is a divisional of application Ser. No. 07/987,957 filed on Dec. 11, 1992 now U.S. Pat. No. 5,487,275.

TECHNICAL FIELD

This invention relates to gas turbine combustors; and, in particular, to improvements in gas turbine combustors for the further reduction of air pollutants such as nitrogen oxides (NOx).

BACKGROUND PRIOR ART

In an effort to reduce the amount of NOx in the exhaust gas of a gas turbine, inventors Wilkes and Hilt devised the dual stage, dual mode combustor which is disclosed in U.S. Pat. No. 4,292,801 issued Oct. 6, 1981 to a common assignee of the present invention, and incorporated herein by reference. In this patent, it is disclosed that the amount of exhaust NOx can be greatly reduced, as compared with a conventional single stage, single fuel nozzle combustor, if two combustion chambers are provided. The specific configuration as described in the above identified patent includes an annular array of primary nozzles each of which discharges fuel into the primary combustion chamber, and a central secondary nozzle which discharges fuel into the secondary combustion chamber. The secondary nozzle has an axial fuel delivery pipe surrounded at its discharge end by an air swirler which provides combustion air to the fuel nozzle discharge. Other components of the combustor include the combustion chamber liner, a venturi arranged in the secondary combustion chamber or zone, and the combustion chamber cap/centerbody.

The combustor is operated by first introducing fuel and air into the first or primary chamber for burning therein. Thereafter, the flow of fuel is shifted into the second chamber until burning in the first chamber terminates, followed by a reshifting of fuel distribution into the first chamber for mixing purposes, with burning occurring only in the second chamber. The combustion in the second chamber is rapidly quenched by the introduction of substantial amounts of dilution air into the downstream end of the second chamber to reduce the residence time of the products of combustion at NOx reducing temperatures thereby providing a motive force for the turbine section which is characterized by low amounts of NOx, carbon monoxide and unburned hydrocarbon emissions.

Further development in this area produced a two stage (diffusion/premixing) secondary fuel nozzle as described in commonly assigned U.S. Pat. No. 4,982,570. As described in the above identified patent, further reduction in the production of NOx may be achieved by altering the design of the central or secondary nozzle to operate as a diffusion piloted premixed nozzle. In operation, a relatively small amount of fuel is used to sustain a diffusion pilot, while a premix section of the nozzle provides additional fuel for ignition of the main fuel supply from the upstream primary nozzles.

It was subsequently discovered that high combustion dynamic pressure activity was present during the transfer to premixed operation. One method of suppressing the combustion dynamics is to use a two-stage (premixed/diffusion) gas only secondary fuel nozzle as described in commonly assigned application Ser. No. 07/680,073 (now allowed).

The entirety of the '073 application is incorporated herein by reference.

SUMMARY OF THE INVENTION

This invention relates to the identification of two additional methods for suppressing combustion dynamics in a dual stage, dual mode combustion system as described '801 and '570 patents. One such method involves fuel injection from the aft cone portion of the venturi in the second combustion chamber, and the other method involves fuel injection from the outer swirler portion of the centerbody.

It is thus the principal objective of this invention to provide additional means by which high combustion dynamic pressure activity during the transfer to premixed operation can be minimized. Thus, the combustor in accordance with this invention employs a third or tertiary fuel stage to minimize combustion driven pressure pulsations while transferring to the premixed operating mode. In a first exemplary embodiment of the invention, a plurality of tubes are mechanically attached to the aft cone portion of the venturi between the primary and secondary combustion chambers or zones. The individual tubes are manifolded together and a single fuel line supplies the system. This arrangement forms a tertiary fuel system and, during the transfer to premixed operation, fuel is supplied to the tubes and injected into the secondary combustion chamber. This provides a stable pilot for unburned mixture exiting the first stage, and the increased flame stability results in lower dynamic pressures during the transfer.

In another exemplary embodiment, a plurality of tubes are located axially along the centerbody and exit in the slots of the centerbody outer swirler. The individual tubes again are manifolded together and supplied with fuel from a single fuel line. During the transfer to premixed operation, fuel is supplied to these tubes for injection into the secondary combustion chamber or zone, and the injected fuel efficiently incinerates the low concentration transferred premix gas resulting in high combustion efficiency, and reduced dynamic pressures during the transfer to the premixed mode.

During the transfer to premixed operation, 100% of the fuel must be delivered directly to the second stage in order to flame out the primary combustion zone. During the transfer to premixed operation in accordance with this invention 100% of the fuel is delivered to the tertiary fuel system (either the venturi or centerbody). This will cause flame-out in the primary combustion chamber and a stable diffusion flame operation in the secondary combustion chamber. Once flame out occurs in the primary chamber, a portion of the fuel may be transferred back to the primary nozzles in the primary zone and the remaining fuel transferred to the premixing secondary fuel nozzle for operation in the premixed mode.

Thus, in its broadest aspects, the invention relates to an improved gas turbine combustor of the type including primary and secondary combustion chambers with a venturi located between said primary and secondary combustion chambers; a plurality of primary fuel injection nozzles secured to a combustor cap in an annular array upstream of the primary combustion chamber, and a centerbody including a secondary fuel nozzle, said centerbody extending from said combustor cap to said secondary combustion chamber; the improvement comprising a plurality of tertiary fuel injection nozzles arranged in a circular array about a longitudinal axis of the combustor for injecting fuel into the secondary combustion chamber.

The invention also provides a method of suppressing combustion dynamics during transfer from a primary mode to the premixed mode of operation in a dual stage gas turbine combustor which includes primary and secondary combustion chambers separated by a venturi and supplied with fuel from primary and secondary fuel nozzles respectively and wherein, in a primary mode fuel is fed to the primary combustion chamber by said primary fuel nozzles for burning in the primary combustion chamber only, and in a premixed mode fuel is fed to the primary combustion chamber by said primary fuel nozzles for premixing with air and for burning in the secondary combustion chamber, comprising the steps of:

a) during transfer from the primary to the premixed mode of operation, diverting 100% of the fuel to a plurality of tertiary fuel nozzles arranged in circular array about a longitudinal axis of the combustor, proximate but not upstream of a throat portion of the venturi, for injection into the secondary combustion chamber, thereby causing flame out on the primary combustion chamber and providing a stable diffusion flame on the secondary combustion chamber; and (b) upon flame out in the primary combustion chamber, diverting a portion of the fuel back to the primary fuel nozzles for injection of fuel into the primary combustion chamber for premixing with air, and diverting the remaining portion of the fuel to the secondary fuel nozzle for injection into the secondary combustion chamber.

Additional objects and advantages will become apparent from the detailed description which follows.

BEST MODE FOR CARRYING OUT THE INVENTION

Figure 1:
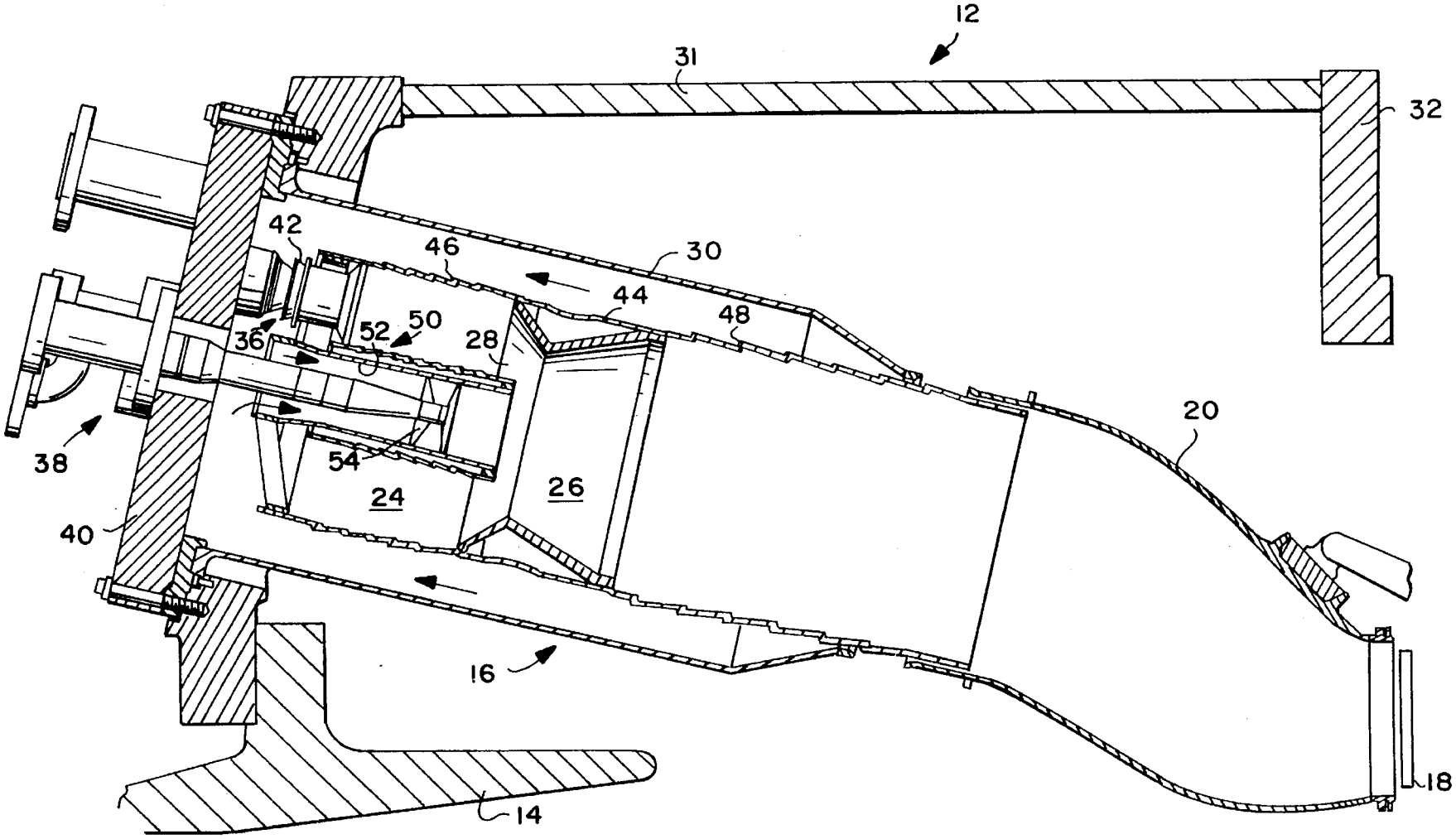
FIG. 1 (PRIOR ART)
FIG. 1 is a partial side sectional view of a known dry low NOx combustor.

Referring to FIG. 1, a gas turbine 12 of the type disclosed in U.S. Pat. No. 4,292,801 includes a compressor 14, a combustor 16 and a turbine represented for the sake of simplicity by a single blade 18. Although it is not specifically shown, it is well known that the turbine is drivingly connected to a compressor along a common axis. The compressor 14 pressurizes inlet air which is then turned in direction or reverse flowed to the combustor 16 where it is used to cool the combustor and also used to provide air to the combustion process. The gas turbine includes a plurality of the generally cylindrical combustors 16 (only one shown) which are located about the periphery of the gas turbine. In one particular gas turbine model, there are fourteen such combustors. A transition duct 20 connects the outlet end of its particular combustor with the inlet end of the turbine to deliver the hot products of the combustion process to the turbine.

Each combustor 16 comprises a primary or upstream combustion chamber 24 and a secondary or downstream combustion chamber 26 separated by a venturi throat region 28. The combustor 16 is surrounded by a combustor flow sleeve 30 which channels compressor discharge air flow to the combustor. The combustor is further surrounded by an outer casing 31 which is bolted to the turbine casing 32.

Primary nozzles 36 provide fuel delivery to the upstream combustion chamber 24 and are arranged in an annular array around a central secondary nozzle 38. In one model gas turbine, each combustor may include six primary nozzles and one secondary nozzle. Each of the primary nozzles 36 protrudes into the primary combustion chamber 24 through a rear wall 40. Secondary nozzle 38 extends from the rear wall 40 to the throat region 28 in order to introduce fuel into the secondary combustion chamber 26. Fuel is delivered to the nozzles 36 through fuel lines (not shown) in a manner well known in the art and described in the aforementioned '801 patent. Ignition in the primary combustion chamber is caused by a spark plug and associated cross fire tubes, also well known in the art, and omitted from the present drawings for the sake of clarity.

Combustion air is introduced into the fuel stage through air swirlers 42 positioned adjacent the outlet ends of nozzles 36. The swirlers 42 introduced swirling combustion air which mixes with the fuel from nozzles 36 and provides an ignitable mixture for combustion, on start-up, in chamber 24. Combustion air for the swirlers 42 is derived from the compressor 14 and the routing of air between the combustion flow sleeve 30 and the wall 44 of the combustion chamber.

The cylindrical liner wall 44 of the combustor is provided with slots or louvers 46 in the primary combustion chamber 24, and similar slots or louvers 48 downstream of the secondary combustion chamber 26 for cooling purposes, and for introducing dilution air into the combustion zones to prevent substantial rises in flame temperature.

The secondary nozzle 38 is located within a centerbody 50 and extends through a liner 52 provided with a swirler 54 through which combustion air is introduced for mixing with fuel from the secondary nozzle as described in greater detail below.

The apparatus, as described above, is substantially as shown in the above identified '801 patent.

Figure 2:
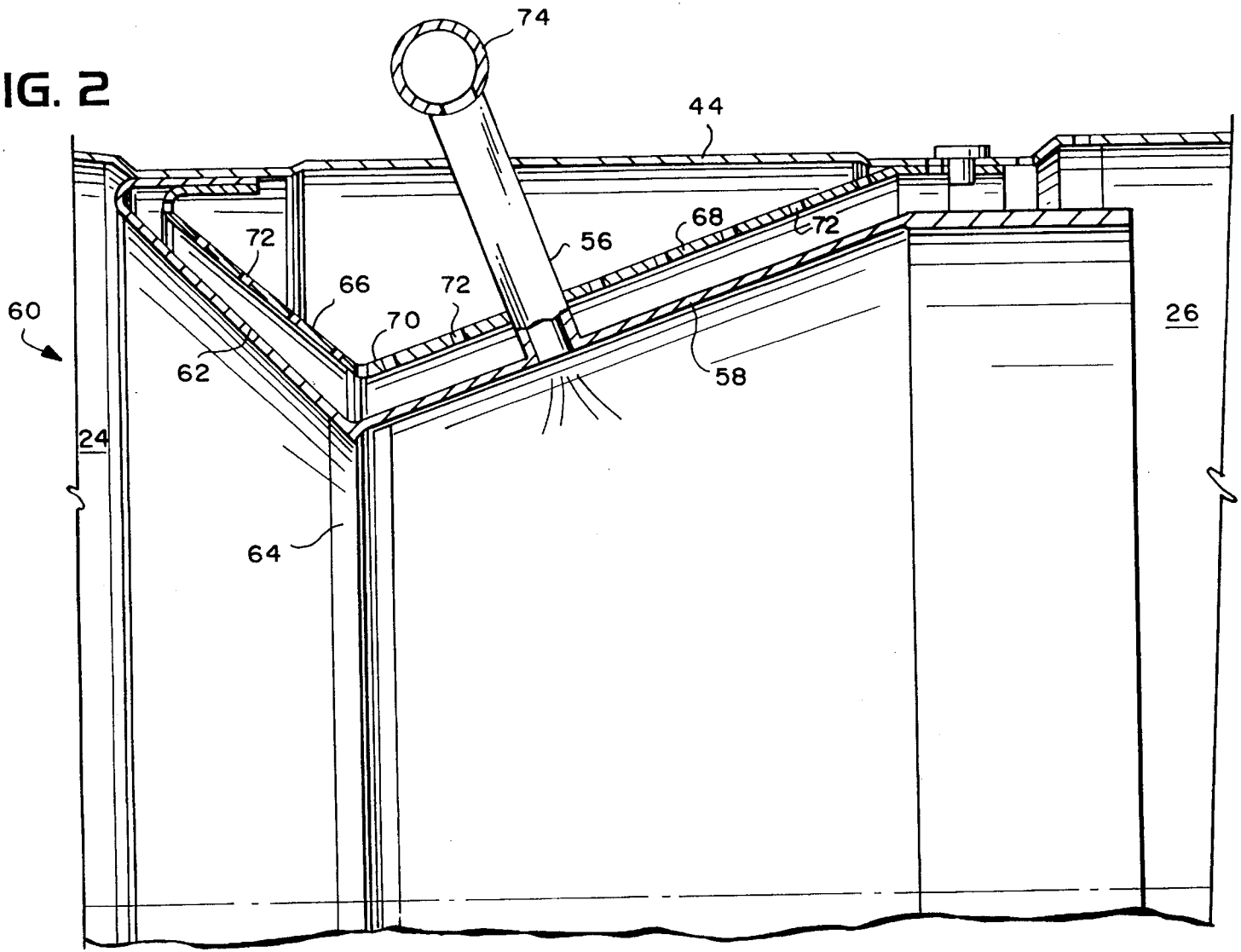
FIG. 2 is a partial side section of a portion of a combustor as shown in FIG. 1 but incorporating a tertiary fuel injection system in accordance with this invention.

With reference now to FIG. 2, a tertiary or third fuel stage in accordance with a first exemplary embodiment of the invention includes a plurality of fuel injection tubes 56 (one shown) mechanically attached to, and arranged circumferentially about the aft or diverging cone portion 58 of the venturi 60 (corresponding to the venturi 28 in FIG. 1). The venturi 60 also includes a converging portion 62 upstream of the aft or diverging portion 58, with the two portions meeting at the throat portion 64. The venturi 60 as illustrated has an outer wall construction which follows the contours of the converging and diverging portions of the venturi but in radially spaced relation thereto. Thus, an outer converging wall portion 66 is joined to an outer diverging wall portion 68 at a throat region 70. The outer wall is provided with a plurality of cooling apertures 72 by which the venturi wall sections 58 and 62 may be impingement cooled via compressor air to reduce temperatures along the venturi.

The plurality of fuel injection tubes 56 are arranged circumferentially about the diverging wall portion 58 of the venturi, extending through the outer diverging wall 68 as shown in FIG. 2. While only one tube 56 is shown, it will be appreciated that as few as 2 or as many as eight such tertiary fuel injection tubes 56 may be spaced circumferentially about the venturi. All of the tubes 56 are connected to a common manifold 74 which supplies fuel from a single fuel line (not shown) to each of the fuel injection tubes 56.

The matter of fuel supply and appropriate manifolding are considered within the skill of the art and need not be described here, other than to say that the manifold may be located (1) externally of the combustor liner (as shown in FIG. 2); (2) in the chamber 76 between the liner 44 and the venturi 60; or (3) externally of the combustor 30.

During the transfer to the premixed mode of operation, 100% of the fuel is supplied to the fuel injection tubes 56, thereby causing flame out in the primary combustion chamber 24, while providing in the secondary combustion chamber 26 a stable pilot for unburned mixture existing the first stage. In other words, a stable diffusion flame operation is provided in the second stage chamber 26 and, once flame out occurs in the primary combustion chamber 24, a portion of the fuel can then be transferred back to the primary fuel injection nozzles for pre-mixing purposes in the primary combustion chamber 24, while the remaining portion is transferred to the secondary fuel nozzle 38, with burning thereafter occurring only in the secondary combustion chamber 26.

Figure 3:
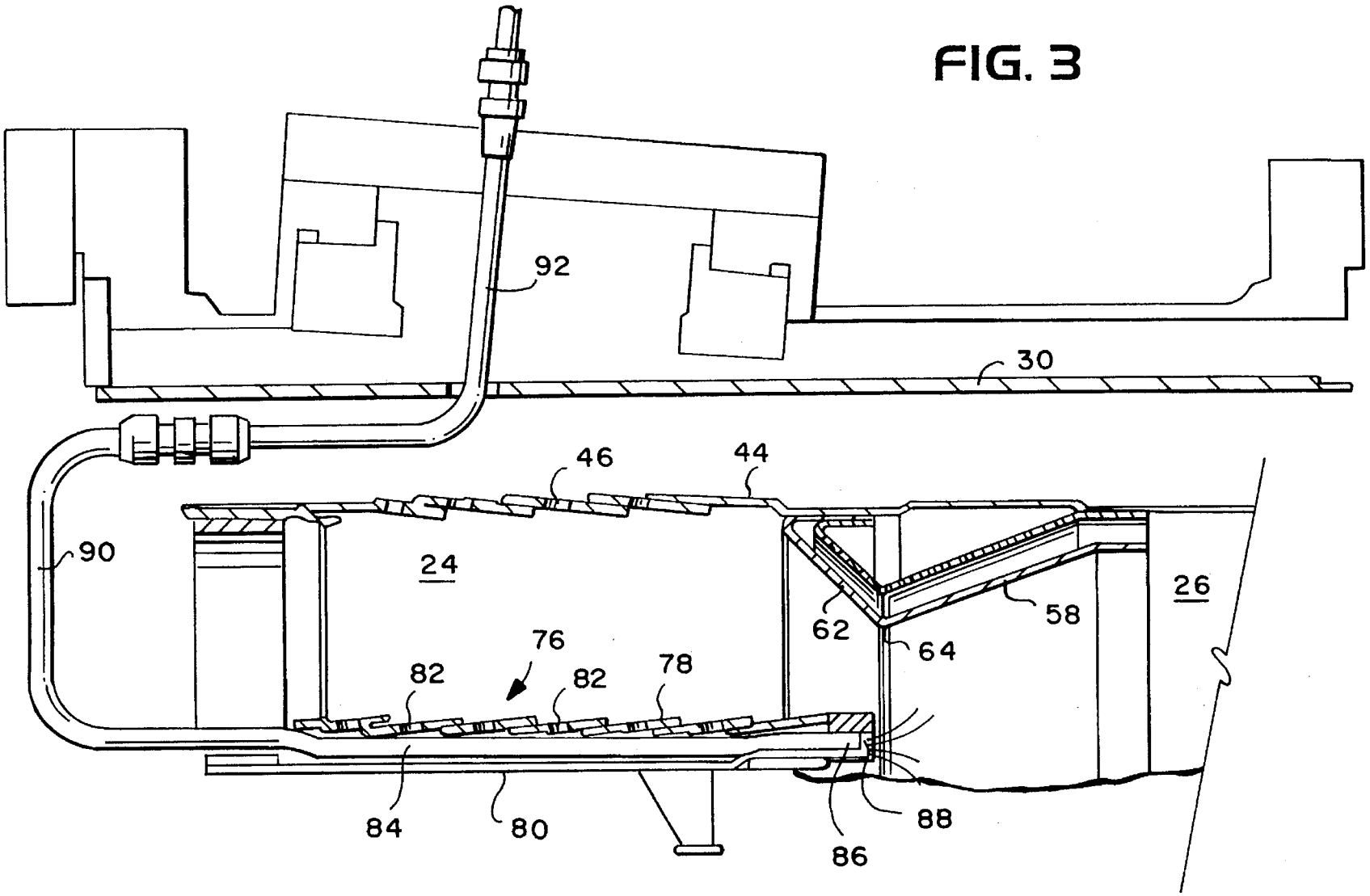
FIG. 3 is a partial side section of a portion of a combustor as shown in FIG. 1 but incorporating a tertiary fuel injection system in accordance with another embodiment of the invention.

Turning now to FIG. 3, a centerbody 76 is illustrated which corresponds generally to the centerbody 50 shown in FIG. 1. Centerbody 76 includes an outer wall or swirler 78 spaced from the secondary nozzle liner 80, with a plurality of axially and circumferentially spaced apertures arranged along the wall 78 for cooling purposes and for introducing and swirling dilution air into the combustion zone to prevent substantial rises in flame temperature.

A plurality of fuel injection tubes 84 (one shown, but, again, between 2 and 8 may be utilized about the circumference of the liner 80, with four being presently preferred) are arranged to extend axially along the centerbody 76 in the radial space between the swirler 78 and liner 80, and to extend at their respective discharge ends 86 through slots 88 between the centerbody outer swirler 78 and liner 80. Here again, the individual tubes 84 are preferably manifolded together via conduits such as 90, 92 and supplied by a single fuel line (not shown).

As in the first described embodiment, during the transfer to pre-mixed operation, 100% of the fuel is supplied to the tubes 84 for injection into the secondary combustion chamber 26. The injected fuel efficiently incinerates the low concentration transferred premixed gas from the primary combustion chamber 24, resulting in high combustion efficiency during the transfer. Here again, the arrangement allows flame out in the primary combustion chamber 24 and a stable diffusion flame operation in the second stage. Once the primary combustion chamber flames out, a portion of the fuel will be transferred back to the primary fuel injection nozzles for premixing in the chamber 24, and the remaining fuel will be transferred to the premixing secondary fuel nozzle for operation in the premixed mode, i.e., with burning only in the secondary chamber 26.

In both embodiments, the tertiary fuel must be introduced at or downstream of the throat portion 64 of the venturi 60 to ensure the desired result.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A method of suppressing combustion dynamics during transfer from a primary mode to a premixed mode of operation in a dual stage gas turbine combustor which includes primary and secondary combustion chambers separated by a venturi and supplied with fuel from primary and secondary fuel nozzles respectively and wherein, in a primary mode fuel is fed to the primary combustion chamber by said primary fuel nozzles for burning in the primary combustion chamber only, and in a premixed mode fuel is fed to the primary combustion chamber by said primary fuel nozzles for premixing with air and for burning in the secondary combustion chamber, comprising the steps of:

a) during transfer from the primary to the premixed mode of operation, diverting 100% of the fuel to a plurality of tertiary fuel nozzles arranged in circular array about a longitudinal axis of the combustor, proximate but not upstream of a throat portion of the venturi, for injection into the secondary combustion chamber, thereby causing flame out on the primary combustion chamber and providing a stable diffusion flame on the secondary combustion chamber; and (b) upon flame out in the primary combustion chamber, diverting a portion of the fuel back to the primary fuel nozzles for injection of fuel into the primary combustion chamber for premixing with air, and diverting the remaining portion of the fuel to the secondary fuel nozzle for injection into the secondary combustion chamber.

2. The method of claim 1 wherein said tertiary fuel nozzles are located to inject fuel substantially radially into said secondary combustion chamber.

3. The method of claim 2 wherein said venturi has converging and diverging wall portions and wherein said tertiary fuel nozzles are mounted in said diverging portion.

4. The method of claim 3 wherein each of said tertiary fuel nozzles is connected to a common fuel supply manifold.

5. The method of claim 1 wherein said centerbody includes an outer swirler wall spaced radially outwardly of said secondary fuel nozzle and wherein said tertiary fuel nozzles are located radially between said outer wall and said secondary fuel nozzle.

6. The method of claim 5 wherein said tertiary fuel nozzles are arranged to inject fuel substantially axially into said secondary combustion chamber.

7. The method of claim 6 wherein said all of said tertiary fuel nozzles are connected to a common fuel supply manifold.

8. The method of claim 1 wherein said outer swirler wall is formed with a plurality of cooling apertures.

9. The method of claim 3 wherein said tertiary nozzles are mounted substantially perpendicularly to said diverging wall so that fuel exiting said tertiary fuel nozzles has an axial component of flow.

* * * * *